US009132316B2

(12) United States Patent
Lima et al.

(10) Patent No.: US 9,132,316 B2
(45) Date of Patent: Sep. 15, 2015

(54) WEIGHT-ADJUSTABLE SURFACE GLIDING APPARATUS AND METHODS FOR MULTIPURPOSE FITNESS

(71) Applicant: Energeia Fitness, LLC, San Jose, CA (US)

(72) Inventors: Jennifer S Lima, Los Gatos, CA (US); Darlene L Polistico, San Jose, CA (US)

(73) Assignee: Energeia Fitness, LLC

( * ) Notice: Subject to any disclaimer, the term of this patent is extended or adjusted under 35 U.S.C. 154(b) by 153 days.

(21) Appl. No.: 14/049,970

(22) Filed: Oct. 9, 2013

(65) Prior Publication Data

US 2014/0100090 A1 Apr. 10, 2014

Related U.S. Application Data

(60) Provisional application No. 61/711,746, filed on Oct. 10, 2012.

(51) Int. Cl.

| | |
|---|---|
| ***A63B 21/00*** | (2006.01) |
| ***A63B 21/068*** | (2006.01) |
| ***A63B 22/00*** | (2006.01) |
| ***A63B 23/08*** | (2006.01) |
| ***A63B 23/10*** | (2006.01) |
| ***A63B 23/16*** | (2006.01) |
| ***A63B 71/00*** | (2006.01) |
| ***A63B 23/12*** | (2006.01) |
| ***A63B 21/072*** | (2006.01) |
| ***A63B 21/075*** | (2006.01) |

(52) U.S. Cl.

CPC ..... *A63B 23/1236* (2013.01); *A63B 21/0004* (2013.01); *A63B 21/00065* (2013.01); *A63B 21/00094* (2013.04); *A63B 21/072* (2013.01); *A63B 21/075* (2013.01); *A63B 21/143* (2013.01); *A63B 21/1438* (2013.01); *A63B 21/1449* (2013.01); *A63B 21/1465* (2013.01); *A63B 21/1469* (2013.01)

(58) Field of Classification Search

CPC ..... A63B 21/0004; A63B 21/00061; A63B 21/00094; A63B 21/00098; A63B 21/00101; A63B 21/00116; A63B 21/00163; A63B 21/00174; A63B 21/00185; A63B 21/0618; A63B 21/065; A63B 21/068; A63B 21/072; A63B 21/0726; A63B 21/0728; A63B 21/143; A63B 21/1438; A63B 21/1465; A63B 21/1469; A63B 21/1484; A63B 21/1488; A63B 22/002; A63B 22/22; A63B 22/201; A63B 22/203; A63B 23/1236

See application file for complete search history.

(56) References Cited

U.S. PATENT DOCUMENTS

| | | | | |
|---|---|---|---|---|
| 8,926,482 | B2 * | 1/2015 | Miller, Jr. | 482/132 |
| 2005/0245372 | A1 * | 11/2005 | Mylrea et al. | 482/148 |
| 2006/0014615 | A1 * | 1/2006 | Godbold | 482/141 |
| 2010/0317496 | A1 * | 12/2010 | Abranchess | 482/141 |
| 2012/0083396 | A1 * | 4/2012 | Aquino | 482/131 |
| 2013/0252791 | A1 * | 9/2013 | Chang | 482/132 |
| 2014/0135189 | A1 * | 5/2014 | Thomason et al. | 482/141 |

* cited by examiner

*Primary Examiner* — Oren Ginsberg
(74) *Attorney, Agent, or Firm* — Fang Wu

(57) ABSTRACT

An exercise apparatus for surface-based gliding is provided. The gliding apparatus includes a handle structure including a handle-bar having two handle-ends respectively mounted on two end-base structures and a disk structure having a weight member clamped to a base member. The disk structure is removably coupled to the handle structure by locking the two end-base structures to two edge regions across the weight member. The two edge regions are configured for coupling from below to an alternative disk structure. The handle structure is configured to allow a user to engage anywhere from the handle-bar to a top surface of the disk structure to drive said disk structure with the base member gliding against a surface in an arbitrary direction for exercise. Exercise methods of using the gliding apparatus are also provided.

35 Claims, 6 Drawing Sheets

WEIGHT-ADJUSTABLE SURFACE GLIDING APPARATUS AND METHODS FOR MULTIPURPOSE FITNESS

CROSS-REFERENCES TO RELATED APPLICATIONS

This application claims priority to U.S. Provisional Patent Application No. 61/711,746, filed on Oct. 10, 2012, commonly assigned, and hereby incorporated by reference in its entirety herein for all purposes.

This application is related to U.S. patent application Ser. Nos. 29/434,197, 29/434,198, and U.S. Pat. No. D562,918.

BACKGROUND OF THE INVENTION

The present invention relates generally to a personal fitness apparatus and training method. More particularly, the present invention provides a weight-adjustable surface gliding apparatus for multipurpose body fitness and training. Merely by way of examples, the present invention is implemented as a surface-based personal mini training system with adjustable weight loads through single or both hands (and feet) engagement to drive a versatile surface gliding motion for total body exercise, but it would be recognized that the invention may have other applications.

The human body through mainly four limbs moves in multiple directions and incorporates multitude of muscles all working in combination simultaneously. Total body controls in strength, mobility, flexibility, cardio-conditioning, balance, muscle stretch and coordination are very important for daily life. People trying to achieve the best fitness result from using exercise equipments usually find that either the existing devices hardly allow the user to simultaneously train all the aspects mentioned above or the devices are usually complex in operation, too expensive to own, or simply lack of fun. Floor exercises like aerobics or Yoga can be very personal, easy, and fun, but without assistant of proper device the exercise may be limited to not cover all aspects of body training. For example, existing Gliding Discs introduced an alternative way for doing aerobics with one or two body parts (hands, feet, or hip) under guidance or motion control. But the device basically serves a passive body support and not provides any enhancement in muscle strength build and core stability training. Other device like XDrifft provides an apparatus used for floor-based gliding exercise that supports training on almost all body aspects, but it lacks features in adjusting the weight load for providing personalized training flexibility in advanced levels.

From the above, it is seen that improved personal fitness devices with adjustable weight loads for multi-purpose surface-based body training are desired.

BRIEF SUMMARY OF THE INVENTION

The present invention relates generally to a personal fitness apparatus and training method. More particularly, the present invention provides a weight-adjustable surface gliding apparatus for multipurpose body fitness and training. Merely by way of examples, the present invention is implemented as a surface-based personal mini training system with adjustable weight loads with both hands and feet engagement to drive a versatile gliding motion against a surface to provide total body exercise, but it would be recognized that the invention may have other applications.

In a specific embodiment, the present invention provides an exercise apparatus for surface-based gliding. The apparatus includes a handle structure including a handle-bar having two handle-ends respectively mounted on two end-base structures. Additionally, the apparatus includes a disk structure having a weight member clamped to a base member. The disk structure is removably coupled to the handle structure by locking the two end-base structures to two edge regions across the weight member. The two edge regions are configured for coupling from below to an alternative disk structure. Furthermore, the handle structure is configured to allow a user to engage anywhere from the handle-bar to a top surface of the disk structure to drive said disk structure with the base member gliding against a surface in an arbitrary direction for exercise.

In another specific embodiment, the invention provides an exercise apparatus for gliding against a surface. The apparatus includes a handle structure including a handle-bar having two handle-ends respectively mounted on two end-base structures. Each end-base structure is associated with a first latch locking device. Additionally, the apparatus includes a disk structure including a pair of edge structures. Each edge structure is associated with a pin segment and a second latch locking device. The pin segment is configured to engage upward with the first latch locking device to couple the disk structure to the handle structure. The second latch locking device is configured for engaging downward with a pin segment associated with an alternative disk structure. The alternative disk structure is a substantial duplication of the disk structure. Furthermore, the handle structure is configured to allow a user to engage and drive the coupled disk structure with its bottom side gliding in an arbitrary direction against a surface for exercise.

In an alternative embodiment, the present invention provides a method for a user to use one or more weight-adjustable gliding apparatuses for total body exercise. The method includes placing one or more gliding apparatuses on a floor. Each of the one or more gliding apparatuses includes a handle structure including a handle-bar having two handle-ends respectively mounted on two end-base structures. Each gliding apparatus additionally includes a disk structure having a weight member clamped to a base member. The disk structure is removably coupled to the handle structure by locking the two end-base structures to two edge regions across the weight member. The two edge regions are configured for coupling from below to an alternative disk structure. Additionally, the method includes using one hand to grab the handle structure of one of the one or more gliding apparatuses while using the other hand for either grabbing the same handle structure of or holding flat on the disk structure below the handle structure of another one of the one or more gliding apparatuses. Furthermore, the method includes lowering the user's body down while keeping the whole body substantially straight by applying muscular forces from four limbs with each hand holding the handle structure of the gliding apparatus against the floor and both feet on the floor. Moreover, the method includes driving the gliding apparatus to initiate a gliding motion against the floor by bending and stretching the arms up to user's arm length. The gliding motion is in an arbitrary direction controlled by adjusting muscular forces via one or two hands holding the handle structure of the gliding apparatus while keeping a balance of the whole body above the floor except the feet. In a specific embodiment, the gliding apparatus further includes an alternative disk structure coupled from below to the disk structure to add total weight of the gliding apparatus. The alternative disk structure is substantially the same as the disk structure.

In another alternative embodiment, a method of using a weight-adjustable gliding apparatus for total body exercise is provided. The method includes placing a gliding apparatus on a floor. The gliding apparatus includes a handle structure including a handle-bar having two handle-ends respectively mounted on two end-base structures and a disk structure having a weight member clamped to a base member. The disk structure is removably coupled to the handle structure by locking the two end-base structures to two edge regions across the weight member. The two edge regions are configured for coupling from below to an alternative disk structure. Additionally, the method includes using both hands to engage with the gliding apparatus, with one hand grabbing the handle structure while the other hand either grabbing the same handle structure or holding flat on the disk structure below the handle structure. Furthermore, the method includes lowering the user's body down while keeping the whole body above the floor except both feet by applying muscular forces from four limbs with both hands holding the handle structure of the gliding apparatus against the floor. Moreover, the method includes driving the gliding apparatus to initiate a gliding motion against the floor by coordinating total body position while keeping both feet together stationary on the floor. In a specific embodiment, the method includes further coupling an alternative disk structure from below to the disk structure to add total weight of the gliding apparatus. The alternative disk structure is substantially the same as the disk structure.

In yet another alternative embodiment, the present invention provides a method for a user to use a floor-based weight-adjustable gliding apparatus for total body exercise. The method includes placing a plurality of gliding apparatuses on a floor. Each gliding apparatus includes a handle structure including a handle-bar having two handle-ends respectively mounted on two end-base structures and a disk structure having a weight member clamped to a base member. The disk structure is removably coupled to the handle structure by locking the two end-base structures to two edge regions across the weight member and the two edge regions are configured for coupling from below to an alternative disk structure. The method further includes holding a handle structure of a first gliding apparatus by one hand of a user and holding a handle structure of a second gliding apparatus by another hand of the user. Each of the first gliding apparatus and the second gliding apparatus is one of the plurality of gliding apparatuses. Additionally, the method includes engaging both feet of the user on the disk structure of a third gliding apparatus with one foot on each side of the handle structure of the third gliding apparatus. The third gliding apparatus is one of the plurality of gliding apparatus. Furthermore, the method includes driving each gliding apparatus held by a hand or engaged by both feet separately to initiate a gliding motion against the floor while keeping user's whole body above the floor.

In still another alternative embodiment, the present invention provides a method for a user to use a surface-based weight-adjustable gliding apparatus for total body exercise. The method includes placing a plurality of gliding apparatuses on a surface. Each gliding apparatus includes a handle structure including a handle-bar having two handle-ends respectively mounted on two end-base structures and a disk structure having a weight member clamped to a base member. The disk structure is removably coupled to the handle structure by locking the two end-base structures to two edge regions across the weight member and leaving an open space between the handle-bar and a top surface of the weight member and the two edge regions are configured for coupling from below to an alternative disk structure. Additionally, the method includes holding a handle structure of a first gliding apparatus by one hand of a user and holding a handle structure of a second gliding apparatus by another hand of the user. Each of the first gliding apparatus and the second gliding apparatus is one of the plurality of gliding apparatuses. Furthermore, the method includes engaging a foot of the user into the open space between the handle-bar and a top surface of the weight member of a third gliding apparatus and engaging another foot of the user into the open space between the handle-bar and a top surface of the weight member of a fourth gliding apparatus. Each of the third gliding apparatus and the fourth gliding apparatus is one of the plurality of gliding apparatuses. Moreover, the method includes driving each gliding apparatus held by a hand or engaged by a foot to independently initiate an arbitrary gliding motion against the surface while coordinating muscular force via each of the four limbs to keep balance of user's whole body in various bending/stretching gestures above the surface.

Many benefits can be achieved by applying the embodiments of the present invention. The present invention provides a personal fitness training apparatus for a user to simply use a hand (or both hands) or a foot (or both feet), or possibly other body part, to engage it and drive a gliding motion against a surface. The gliding surface can be any floor surface conveniently available to the user at home, in office, in fitness house, or on outdoor deck, etc, no matter it is made by solid concrete, hardwood, or covered by tiles, plastic, rock, or fiber material, or carpeted. In a specific embodiment, the invention provide a weight adjustable feature to the apparatus by using self-mounting duplicate disk structures as removable parts to assemble the apparatus. The user can easily adjust his/her exercise strength by adding one or more disk structures to create a same functional gliding apparatus with incremental weight. The weight adjustable feature of the gliding apparatus according to the present invention provides personalized training flexibility for total body exercise in advanced levels. The design of the handle bar and form pad covering the top part of the disk structure allows user to easily engage his hand or foot with comfortable and firm support. These and other benefits may be described throughout the present specification and more particularly below.

DETAILED DESCRIPTION OF THE INVENTION

The present invention relates generally to a personal fitness apparatus and training method. More particularly, the present invention provides a weight-adjustable surface gliding apparatus for multipurpose body fitness and training. Merely by way of examples, the present invention is implemented as a surface-based personal mini training system with adjustable weight loads with both hands and feet engagement to drive a versatile gliding motion against a surface to provide total body exercise, but it would be recognized that the invention may have other applications.

Figure 1:
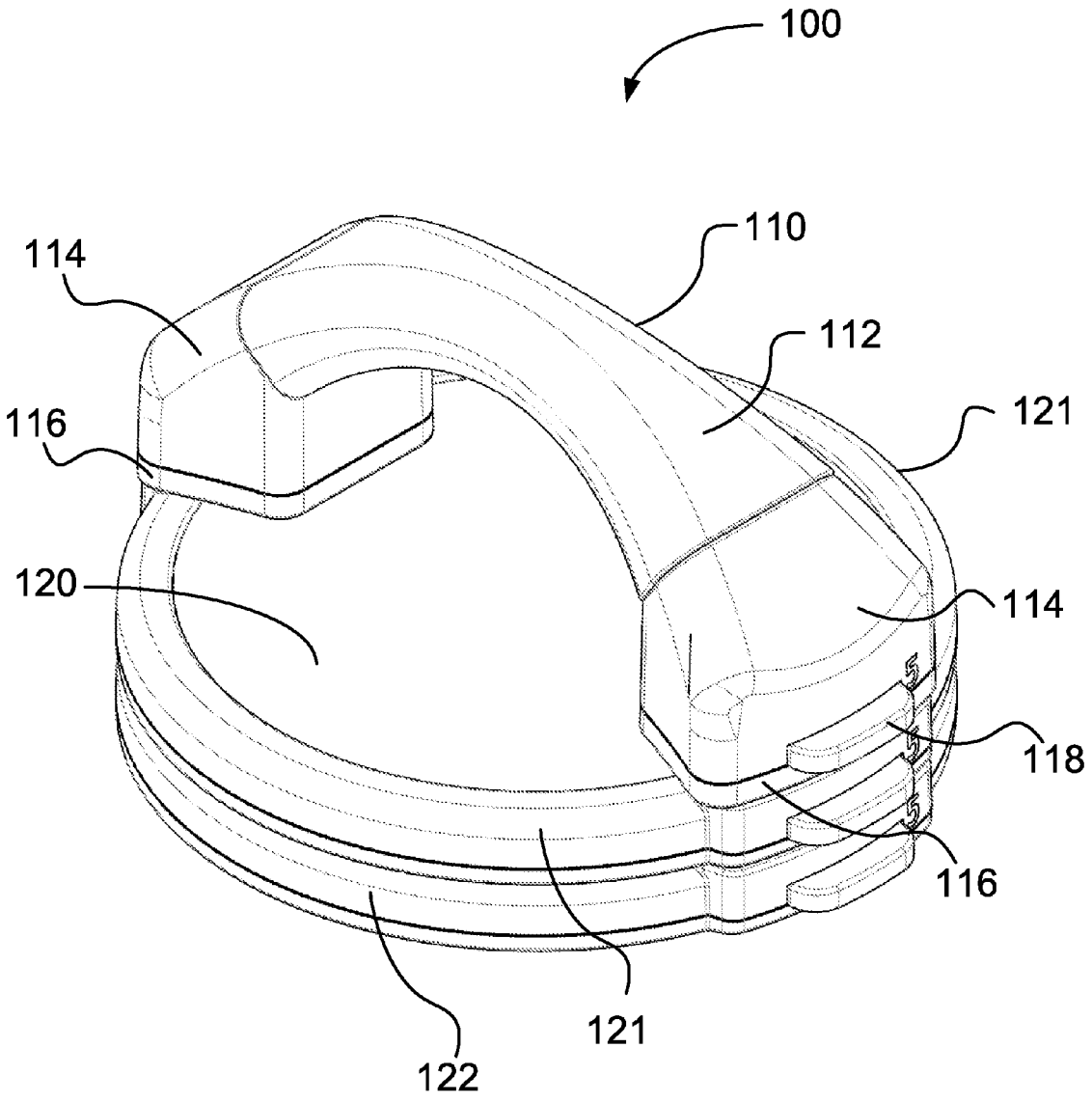
FIG. 1 is a perspective view of a weight-adjustable surface gliding apparatus according to an embodiment of the present invention.

FIG. 1 is a perspective view of a weight-adjustable surface gliding apparatus according to an embodiment of the present invention. This diagram is merely an example, which should not unduly limit the scope of the claims herein. One in ordinary skilled of the art should recognize many alternatives, variations, and modifications. As shown, the gliding exercise apparatus 100 includes one handle structure 110 coupled to one or more disk structures 121 (122, or, more) from below. A lateral dimension of the apparatus is about 7 to 12 inches (though it is not a limiting feature of the apparatus as claimed) for providing conveniently holding by hand of a user. The disk structure 121 includes components being injection molded with Acrylonitrile butadiene styrene (ABS) plastic. The handle structure 110 includes a handle-bar 112 having two handle-ends 114 mounted respectively to two end-base structures 116. The handle structure 110 is coupled to a first disk structure 121 by locking the two end-base structures 116 respectively to two edge regions across the disk structure. In a specific embodiment, the first disk structure 120 is removably locked with the handle structure 110 via an embedded locking device associated with each of the two end-base structures 116. Furthermore each of the corresponding two edge regions of the first disk structure 121 is configured to embed another locking device for coupling a second disk structure 122. The embedded locking device in the edge region of the disk structure provides a first segment for mating upward with the locking device associated with the end-base structure 116 of the handle structure 110. The same embedded locking device in the edge region of the first disk structure 121 also provides a second segment for mating downward with a locking segment in the second disk structure 122. In another specific embodiment, the second disk structure 122 is substantially the same as the first disk structure 121. Each disk structure is configured to bear a standard weight that makes the apparatus a weight adjustable device for exercise with incremental strength. More detail features of this exercise apparatus will be described throughout the specification and particularly below.

Figure 2A:
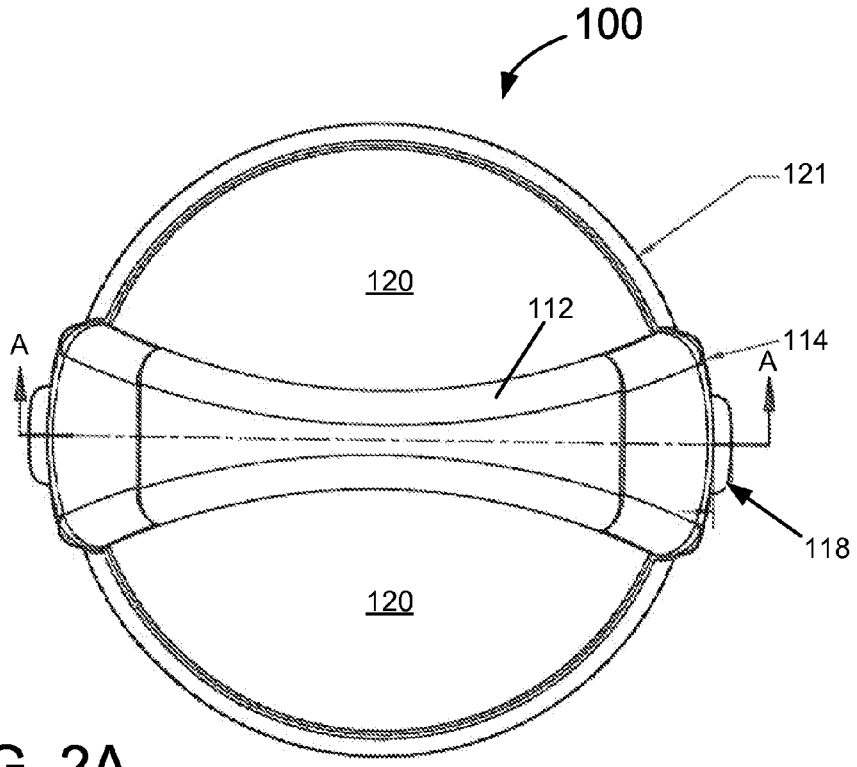
FIG. 2A is a top view of the weight-adjustable surface gliding apparatus depicted in FIG. 1 according to an embodiment of the present invention.

FIG. 2A is a top view of the weight-adjustable surface gliding apparatus depicted in FIG. 1 according to an embodiment of the present invention. This diagram is merely an example, which should not unduly limit the scope of the claims herein. One in ordinary skilled of the art should recognize many alternatives, variations, and modifications. As shown, the handle structure 110 is coupled to the disk structure 121 by locking its two handle-ends 114 to the two edge regions across the disk structure. In an embodiment, the disk structure 121 is configured to be a substantial round shape and the two edge regions for coupling the handle structure are located at the two ends of a diameter across the disk structure. The round shape of the disk structure is just one of many possible designs for the apparatus 100 and should not be a limiting factor for the claims herein. Nevertheless, the round shape may provide certain advantages to yield a symmetric distribution of the force applied by the user through hand/foot engagement with the symmetric handle structure and disk structure. In another embodiment, the coupling between the handle structure 110 and the disk structure 121 is a removable locking characteristics of the exercise apparatus 100. As shown in FIG. 2A, a pushbutton 118 associated with a locking device embedded in each of the two end-base structures (FIG. 1) is partially sticking out from aside of the end-base structure. The side position for disposing the pushbutton 118 is designated to be free from unwanted accidental touching by hand held to the handle-bar region 112 or by foot (in a shoe) engaged the top surface region 120 of the disk structure. Of course, there are many alternatives, variations, and modifications.

Figure 2B:
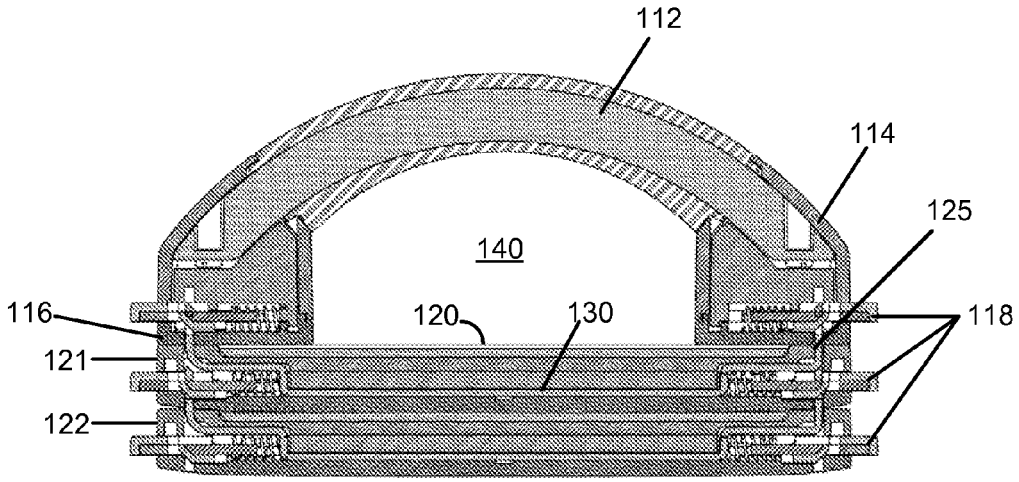
FIG. 2B is a cross-sectional view of the weight-adjustable surface gliding apparatus along AA cut line depicted in FIG. 2A according to an embodiment of the present invention.

FIG. 2B is a cross-sectional view of the weight-adjustable surface gliding apparatus along AA cut line depicted in FIG. 2A according to an embodiment of the present invention. The cross-sectional view reveals some internal elements of the handle structure and the disk structure, including partial revelation of multiple structural elements for coupling the handle structure to a first disk structure and for coupling a second disk structure to the first disk structure. As shown, the pushbutton 118 mentioned in FIG. 2A is shown to be part of a latch locking device inserted between the handle-ends 114 and the end-base structure 116. In an embodiment, the latch locking device is locked with a pin 125 pointed upward from one of the two edge regions of the disk structure 121. The pin 125 is one of two bended end parts of a bracket 130 disposed inside the disk structure 121 across a diameter span from one of the two edge regions to another. The disk structure 121 is thus coupled to the handle structure 110 by inserting two pins 125 respectively to lock with the latch locking devices disposed in two end-base structures 116. The pushbutton 118 serves as a control of locking and releasing mechanism.

In an alternative embodiment, the handle structure 110 includes an arc shaped handle-bar 112, leaving an open space 140 above the top surface region 120 of the disk structure. This space offers alternative room for a user to put his/her hands below the handle-bar and directly onto the top surface region 120. The open space 140 also is large enough for fitting in front part of a shoe, providing additional manner for the user to use his/her foot for engaging and driving the exercise apparatus during gliding exercise. The cross sectional view simply reveals a flat bottom side of the disk structure with its peripheral edge region slightly tilted up for facilitating a gliding motion against a surface. In another alternative embodiment, the cross-sectional view also reveals that the gliding apparatus includes an alternative disk structure 122, which is configured to be substantially the same as the disk structure 121, removably coupled from below to the disk structure 121. The coupling mechanism is substantially the same as one for coupling the handle structure 110 to the disk structure 121. Each disk structure (121 or 122) is made to a standardized structure and weight so that it can be conveniently added to make a gliding apparatus with adjustable weight for providing controlled strength for enhanced exercise. In yet another alternative embodiment, the gliding apparatus can be made of a handle structure 110 and the disk structure 121 directly below as a single piece of body (i.e., not assembled two parts). While an embodiment of the present invention still includes to configure the gliding apparatus to be capable of coupling a separate disk structure (e.g., 122 shown in FIG. 2B) to the bottom of the gliding apparatus. More detail features of this exercise apparatus will be described throughout the specification and particularly below.

Figure 3:
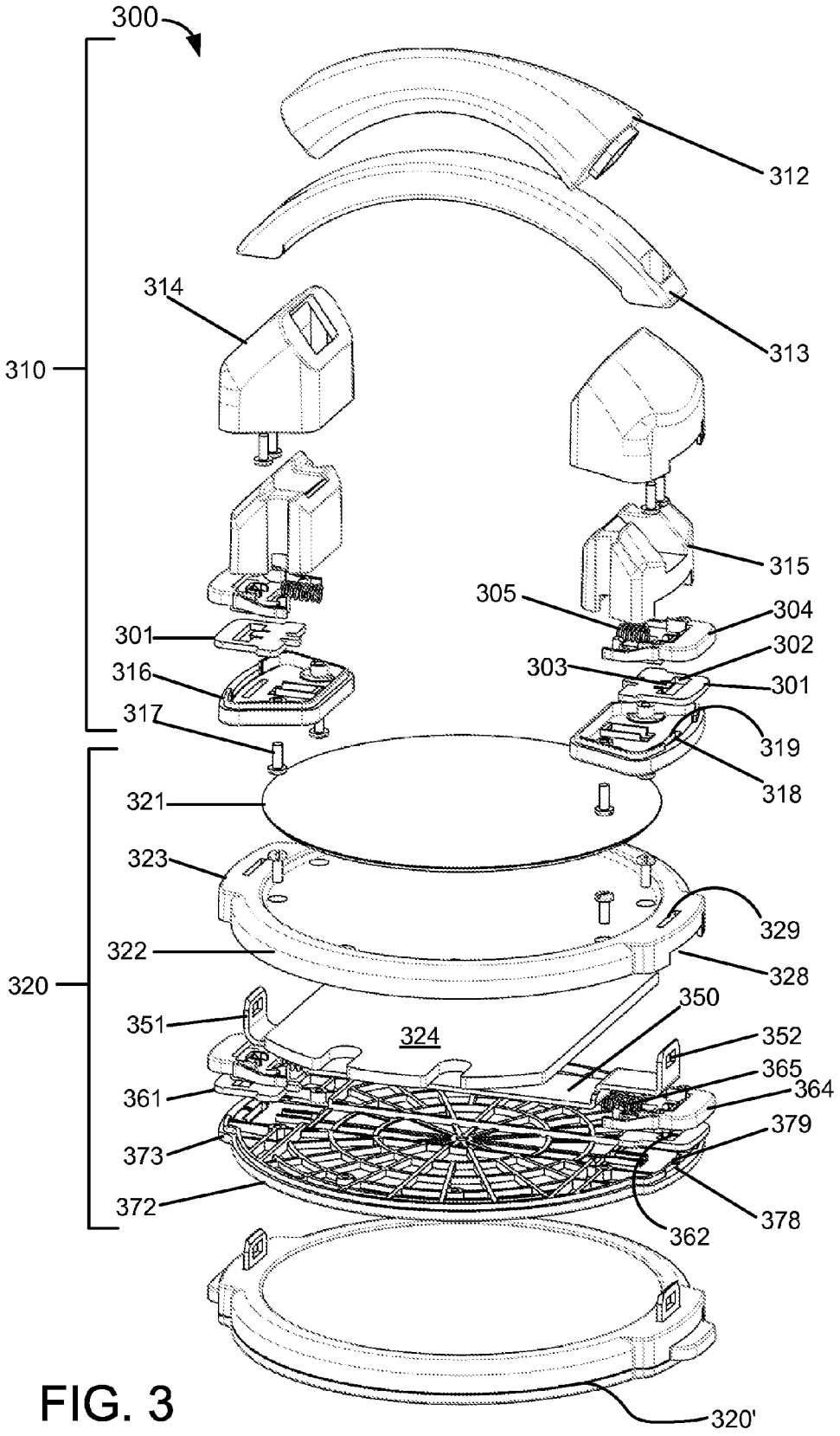
FIG. 3 is an expanded view of a weight-adjustable surface gliding exercise apparatus showing multiple assembled members according to a specific embodiment of the present invention.

FIG. 3 is an expanded view of a weight-adjustable surface gliding exercise apparatus showing multiple assembled members according to a specific embodiment of the present invention. This diagram is merely an example, which should not unduly limit the scope of the claims herein. One in ordinary skilled of the art should recognize many alternatives, variations, and modifications. As shown, a weight-adjustable surface gliding apparatus 300 is depicted in an exploded view showing a handle structure 310 coupled to a disk structure 320. The weight-adjustable surface gliding apparatus 300 can also include a handle structure 310 coupled to a first disk structure 320 plus one or more second structures 320' to add weight. Any of the second disk structures 320' is substantially duplicated from the first disk structure 320 with a base member facilitating gliding motion. In an alternative embodiment, the weight-adjustable surface gliding apparatus 300 can be configured to have a consolidated handle and disk slider with a basic weight (i.e., no removable coupling between the handle and the first disk structure) while it is configured to couple one or more disk structures to add weight based on specific needs of users. FIG. 3 shows just one example of all above optional configurations according to embodiments of the present invention.

Referring to the exemplary exploded view of the weight-adjustable surface gliding exercise apparatus, the handle structure 310 (which is substantially the same as the handle structure 110 in FIG. 1) includes a handle-weight 313 wrapped around by a sleeve 312. The handle-weight 313 is configured to mount its two end regions into a pair of handle-end structures 314 by screws from bottom. The core segment of each handle-end structure 314 includes a handle-end-weight 315 which is mounted to an end-base structure 316 by screws 317 from bottom. The sleeve 312 is an elastomeric, for example Sanoprene material, or rubber material with comfortable touch feeling for hand(s) to hold. While the handle-weight 313 gives mechanical strength with desired weight for supporting part of human weight and applied force for driving the apparatus in surface gilding motion. The handle-end-weight 315 optionally is made by metal with additional weight for balancing the force received by the handle-bar region and distributing the force downward to a coupled disk structure to drive a gliding motion against a floor surface. Both the handle-weight 313 and handle-end-weight 315 mainly contribute to a weight of the handle structure 310 which is configured to be compatible with a weight of a disk structure (320) that is coupled to it from below, so to make a total weight of the apparatus suitable for a total body effect in a weight-adjusted gliding exercise. In an example, the weight of the handle structure is selected within a range of 1 pounds and 10 pounds. In a specific example, the weight of the handle structure is five pounds or less. In another specific example, the weight of the handle structure is three pounds or less.

Referring to FIG. 3 again, a first locking device is inserted between the handle-end-weight 315 and the end-base structure 316 for providing a removable coupling mechanism between the handle structure 310 and a disk structure 320 below. In an embodiment, the locking device is a spring latch device having a shaped latch plate 301 having one end region against a spring 305. A shaped cover 304 is provided for partially capping the shaped latch plate 301 around the spring 305. The latch plate 301 is 10 gage cold rolled steel including a passage 302 next to a stopper segment 303 formed in a middle region. The latch plate 301 is disposed laterally with another end region partially sticking out the end-base structure 316 from a side slot 318 for free engagement. As seen in FIG. 1, this sticking out end region including part of the shaped cover 304 corresponds to a pushbutton 118 for forcing the latch plate 301 to move inward by squeezing the spring 305. The end-base structure 316 includes an opening 319 at its bottom side. As the pushbutton 118 is pushed for squeezing more the spring 305, the latch plate 301 is moved inward to allow the passage 302 to align with the opening 319 so that a pin segment or similar structure can be inserted from below to penetrate both the end-base structure 316 and the latch plate 301. In an embodiment, the pin segment is configured to mate with the latch plate 301 to get locked by the stopper segment 303 as the force applied on the pushbutton 118 is released. As the result, anything associated with the pin segment, for example a disk structure 320, can be coupled to the end-base structure 316. Furthermore, when the pushbutton 118 is pushed again, the pin segment can be released by the stopper segment 303 and further withdrawn back from the passage 302 and the opening 319 so that anything associated with the pin segment is decoupled from the end-base structure 316. Of course, the locking device or coupling mechanism as described is just one example of a removable coupling mechanism associated with the weight-adjustable gliding exercise apparatus 300. One skilled in the art should recognize many other coupling mechanisms for attaching the disk structure to the handle structure, the example shown here in FIG. 3 should not unduly limit the scope of the claims herein.

In another specific embodiment, the coupling mechanism described above is designated for coupling the handle structure 310 to a disk structure 320 as shown in FIG. 3. In an alternative embodiment, the handle structure 310 and the disk structure 320 is formed into a single piece solid structure while keeping the rest features of the surface-gilding apparatus. Additionally this single piece solid structure can be still configured to couple from its bottom side to one or more disk structures as a weight-adjusted exercise apparatus. The exploded view of the FIG. 3 just shows an example of a disk structure configured for coupling with the handle structure above or at least for coupling a redundant disk structure below according to the present invention.

In particular, the disk structure 320 includes a top member 322 and a base member 372 clamped together. A touch pad member 321 comprises a soft form material. In an example, the pad member attached on the top surface region of the disks is a die cut 2-3 lbs closed cell polyethylene foam. It is disposed at the top surface region of the top member 322 of the molded disk structure for facilitating engagement by human body parts (hands or feet) of a user. The top member 322 and the base member 372 have a matching round shape including a pair of edge structures formed across a diameter, wherein edge structure 323 and 373 respectively correspond to top member 322 and base member 372. The two edge structures 323 and 373 are configured to provide a space to hold a pin segment that can be mated with the first locking device associated to the handle structure 310 above and a second locking device that can be used for coupling another disk structure 320' below. The edge structure 323 associated with the top member 322 includes an opening 329 through whole thickness of the top member 322 and a side slot 328. The opening 329 is also configured to align and match in dimension with the opening 319 of the end-base structure 316 so that a channel for coupling the disk structure 320 with the handle structure 310 is provided. The edge structure 373 associated with the base member 370 has a shape matching with the edge structure 323. The edge structure 373 also includes an opening 379 that is aligned with the opening 329 and a side slot 378 that is opposed to the side slot 328 to form a full shaped side opening as the top member 322 is clamped with the base member 370. The opening 379 provides a channel, similar to the opening 319 in the end-base structure 316, for coupling the current disk structure 320 to another disk structure 320' below. The side opening associated with the two end structures 323 and 373 just provides a space to allow part of the second locking device to stick out. More details about the second locking device will be described in following sections of this specification.

In a specific embodiment, the disk structure 320 includes several structural segments that are inserted between the top member 322 and the base member 372, including a disk-weight 324, a shaped bracket 350, and a pair of latch plates 361 with shaped cover 364 and attached spring 365. The disk-weight 324 is a shaped plate disposed at major central region between the top member 322 and the base member 372. The disk-weight 324 can be selected from a group of dense materials including sand cast low grade iron, packaged compressed sand, or other compact materials with proper weight and low cost, for providing a major portion of weight of the disk structure 320 desired as an incremental-loaded part of the whole gliding exercise apparatus (300). For example, the disk-weight 324 is selected to give total weight of the disk structure 320 at five pounds or less which may be standardized for every duplicated disk structure 320'. In another example, the total weight of each reloadable disk structure is selected to be three pounds or less, depending on applications.

The shaped bracket 350 is designated to be a piece of structure that is partly tightened within the disk structure 320 while partly being used for mating with the first locking device associated with the handle structure 310 based on a removable coupling mechanism (partially described in earlier sections of this specification). In an example shown in FIG. 3, the shaped bracket 350 is made of a shaped thickness of material with a middle length portion laid flat between the disk-weight 324 and the base member 372 and two end regions 351 bended upward. In an example, the shaped bracket is 12 gage with a clear zinc plating steel material. Each end region 351 has proper width and thickness matching with the opening 329 associated with the edge structure 323 so that it can be passed through the opening 329 with an extra portion sticking out when the shaped bracket 350 is fully assembled within the disk structure 320. The extra portion sticking out of the opening 329 becomes a pin segment 351, which is in turn configured for coupling the first locking device (associated with the handle structure). In a specific example, the pin segment 351 includes a through-hole 352 near its top end. The whole pin segment 351 is allowed to insert through the opening 319 from below and pass through the passage 302 if the pushbutton 118 (i.e., a sticking out side end of the latch plate 301 with the shaped cover 304) is pushed to certain distance inward. Following that, the through-hole 352 is just designed for the stopper segment 303 of the latch plate 301 to insert and lock the pin segment 351 as the pushbutton 118 is released from initial pushed state. As the result, a coupling between the disk structure 320 and the handle structure 310 is established. Furthermore, when the pushbutton 118 is pushed again, the stopper segment 342 is pushed out of the through-hole 352 to unlock the pin segment 351 so that the pin segment 351 is able to be pulled out of the opening 319 and the disk structure 320 is thus decoupled from the handle structure 310.

The latch plates 361 with shaped cover 364 as well as the associated springs 365 are just parts of a second locking device disposed in the edge structure 373 for providing a removable locking mechanism to couple another disk structure 320' below. In an embodiment, the second locking device is made to be substantially the same as the first locking device equipped mainly with a spring latch device. In particular, the latch plate 361 is substantially the same as the latch plate 301, assembled together with a shaped cover 364 having a same structure as the shaped cover 304. The latch device is assembled together with the base member 722 to align its passage 302 to the opening 379 through the base member and let a pushbutton (i.e., the side end of the latch plate 301 with the shaped cover 304) sticking out of the side opening formed by slot 328 combined with slot 378. Therefore, this latch device is configured to lock with a pin segment associated with another disk structure 320' from below, provided that the disk structure 320' is a duplication of the disk structure 310 described earlier. Of course, there can be other variations, alternatives, and modifications in the disk-to-disk coupling mechanism. The example shown in this specification should not unduly limit the scope of the claims herein.

Figure 4A:
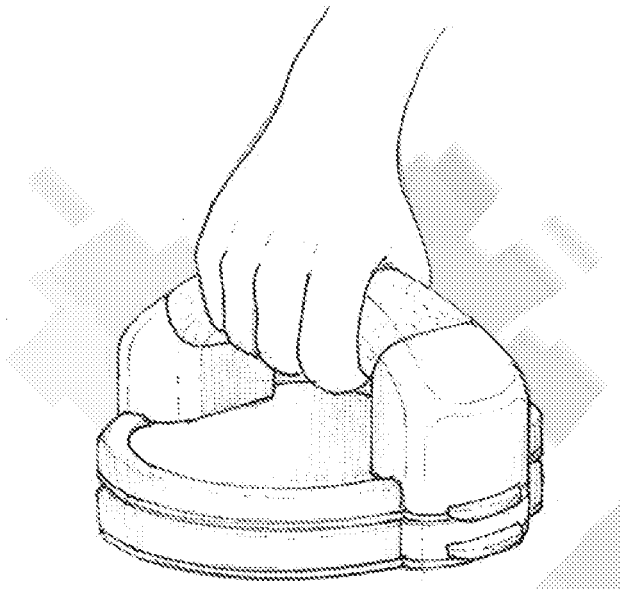
FIGS. 4A-4D are schematic diagrams showing the weight-adjustable surface gliding apparatus with human body engagement in multiple manners according to embodiments of the present invention.

FIGS. 4A-4D are schematic diagrams showing the weight-adjustable surface gliding apparatus with human body engagement in multiple manners according to embodiments of the present invention. These diagrams are merely examples for a user to engage the gliding apparatus in multiple manners for doing exercise, which should not unduly limit the scope of the claims herein. In one embodiment, as shown in FIG. 4A, a user applies a hand to grab the handle structure of the gliding apparatus. The gliding apparatus has its disk structure sitting on a floor surface when the user's hand holds the handle structure. In another embodiment, in FIG. 4B, a user puts both hands on a single gliding apparatus with one hand on handle structure and another hand in a flat position holding the top surface region of the disk structure below the handle structure. Alternative, both hands may hold together the handle structure of a single gliding apparatus. In yet another embodiment, in FIG. 4C, a user uses a foot sliding into the open space between the handle structure and top surface region of the disk structure. Alternatively, in FIG. 4D, the user can engage both feet with the gliding apparatus by placing each toe portion on a top surface region of the disk structure at each side of the handle structure while griping the handle structure in the middle. These figures just show multiple embodiments of the invention for a user to engage the gliding apparatus using hand or foot. Each of the multiple engagement positions can be used alone or combined with one or more other engagement positions for the user to conduct total body exercise following multiple exercise methods according to embodiments of the present invention. More details about the exercise methods of using the gliding apparatus of the present invention are described throughout the specification and particularly below.

Figure 5A:
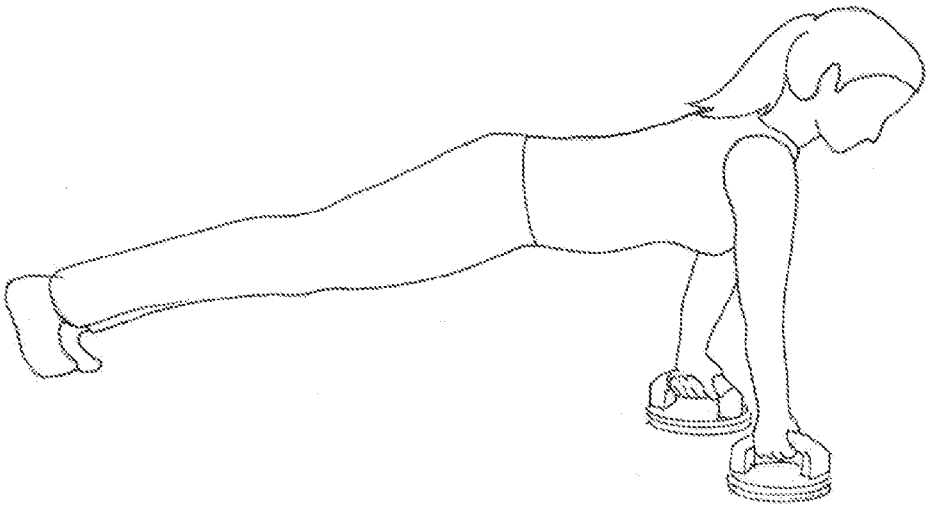
FIGS. 5A and 5B are schematic diagrams showing exemplary methods of using the weight-adjustable surface gliding apparatus for total body exercise according to alternative embodiments of the present invention.
Figure 5B:
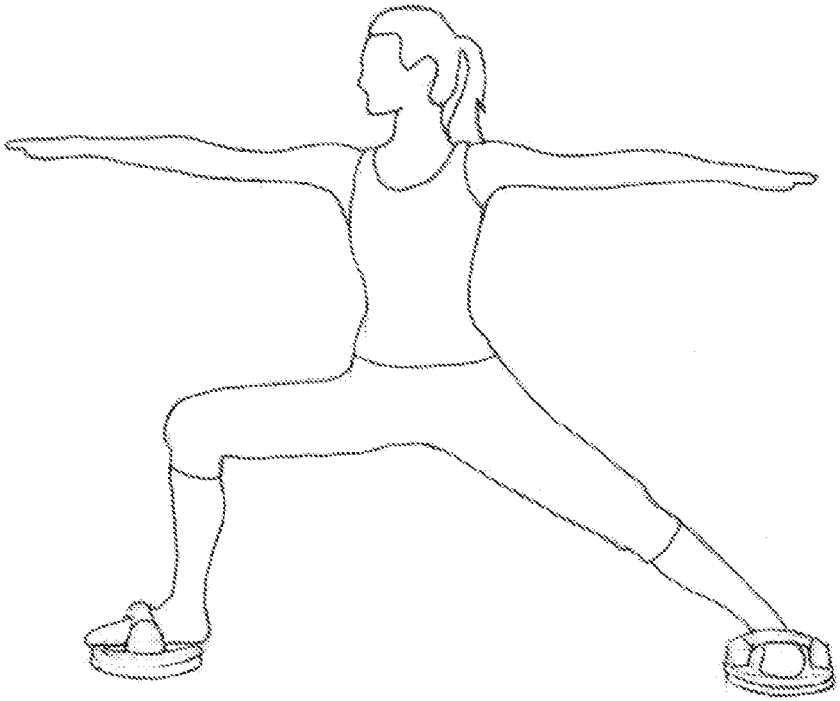

FIGS. 5A and 5B are schematic diagrams showing exemplary methods of using the weight-adjustable surface gliding apparatus for total body exercise according to alternative embodiments of the present invention. These diagrams are merely examples, which should not unduly limit the scope of the claims herein. One skilled in the art should be able to recognize many variations, alternatives, and modifications of the positions the user engaging with the gliding apparatus for doing exercise. In an embodiment, a method for using the gliding apparatus for exercise allows a user to use each hand to respectively hold two gliding apparatus on their handle structure, as shown in FIG. 5A. Each of the two gliding apparatus is placed on a floor surface. The user keeps his/her feet on the floor while lowering his body near the floor and keeping balance above the floor. Then, he/she can drive one or both of the gliding apparatus in gliding motion against the floor by pushing, pulling one or both arms while holding the handle structure firmly. During the gliding motion, the user can bend, twist, rotate, or stretch his/her body for training substantially all body muscles including muscles on neck portion, shoulder region, upper and lower back, chest, abdomen, buttocks, and four limbs. In a specific embodiment, the user can chose to add attachable disk structure to existing gliding apparatus to add desired weight for enhance the muscle training strength in a user-flexible manner. Alternative, the user can use one alternative engagement manner or several combinations of engagement manners to use the one or more weight-adjustable gliding apparatuses for performing surface-gliding exercise.

In another embodiment, the user can optionally to use the gliding apparatus in a standing position with two feet respectively sliding in two gliding apparatuses, as shown in FIG. 5B. The user slides his/her one foot into the opening space between a handle structure and disk structure of a first gliding apparatus and slides another foot similarly in a second gliding apparatus. Then he/she can repeat doing left-right, front-back gliding motion against the floor surface by being one knee while stretching another. This is a method of exercise similar to aerobic exercise did by a person in standing position. But the advantage of the gliding apparatus provided in the present invention gives user a weight control which translates to exercise strength control for enhanced training effect. Of course, there are many variations, alternatives, and modifications. For example, the user may chose to use just one foot sliding in one gliding apparatus while keeps another foot standing on ground. He/she can glide the first apparatus while bending his knee on standing foot (and optionally with one hand holding some fixture). More detail descriptions of one or more exercise methods by using the gliding apparatus can be found throughout the specification and particularly below.

Referring to FIG. 4A, one user engagement with the weight-adjustable surface gliding apparatus for exercise is to hold directly the handle structure. As shown in FIG. 4A, the weight-adjustable surface gliding apparatus is substantially the gliding apparatus 100 in FIG. 1, FIG. 2A, and FIG. 2B. The gliding apparatus has one or more disk structures coupled to the handle structure and sits on a floor surface. Through the hand engagement, user is capable of applying muscular forces to drive the apparatus in a gliding motion against the floor surface in an arbitrary direction. In an embodiment, a method for a user to perform total body exercise using the gliding apparatus over a floor surface is provided, having each hand of the user respectively holding a handle structure of one gliding apparatus. The user keeps his/her both feet on the floor while lowering whole body but still above the floor surface. The whole body is supported by four limbs to keep balance with two hands respectively on gliding apparatuses and two feet on the floor. While maintaining both feet at a stationary state on the floor, the user can adjust his/her arm position to stretch out and pull back repetitively to drive each gliding apparatus under his/her hand to gliding against the floor surface. The gliding motion is substantially in an arbitrary direction. The gliding motion by left hand can be independent to that driven by right hand. For example, one hand can hold the corresponding apparatus stationary while stretching/retracting another arm in motion. In another example, both gliding apparatuses are in gliding motion at the same time while keeping the whole body in balance and above the floor surface by adjusting muscular forces from not only four limbs but also substantially every body parts including neck, chest, upper and lower back, abdomen, even though both feet are kept relative at a stationary state. Basically the user is exercising his/her total body. In an alternative embodiment, the user can attach one more additional disk to each of the two gliding apparatuses from below to add total weight to each gliding apparatus. Now through both hands (as well as corresponding arms) the user needs to apply bigger muscular force to drive the gliding motion of each gliding apparatus. Both feet remain on the floor while providing stronger support through legs and thighs for the balance of the whole body under stronger stress, thereby enhancing strength to the total body exercise.

Figure 4B:
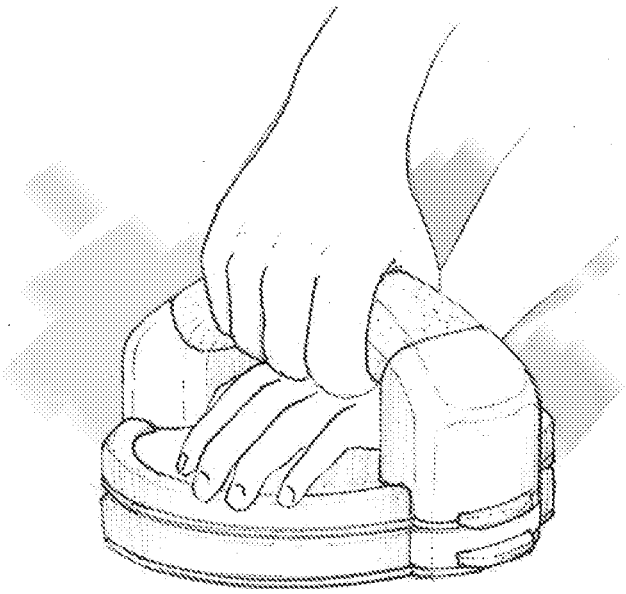

In an alternative embodiment, the method for using the gliding apparatus for conducting total body exercise including using two hands flat holding on disk top portion under the handle structure of two separate apparatus while keeping both feet on floor (see FIG. 4B for the illustration of a hand flat on the disk top). The method of exercise further includes driving the two apparatus to glide against a floor surface by pulling, pushing, stretching, bending the body, twisting the body while keeping the body balanced above the floor. During the gliding motion with body in balance, muscles from substantial every parts of the body, including biceps, triceps, deltoids, chest muscles, back muscles, abdominals, internal and external obliques, lower back, quadriceps, hamstrings, calf muscles, gluteus medius and maximus, are involved and therefore got trained.

In another alternative embodiment, the user can use one hand flat on first one of the gliding apparatus and the other hand holding a handle structure of a second gliding apparatus with both feet on the floor. Now, the user can keep the first gliding apparatus stationary while driving the second gliding apparatus to glide. Optionally, the user can rotate his/her body while lifting the other arm with the hand holding the second gliding apparatus (which simply is used as a weight tool) to stretch up or retrieve down while keeping the first apparatus not to move and the whole body in balance. Of course, there are many variations, alternatives, and modifications.

FIG. 4B is a schematic diagram showing both hands engaging a single weight-adjustable surface gliding apparatus for total body exercise according to another alternative embodiment of the present invention. This diagram is merely an example, which should not unduly limit the scope of the claims herein. One in ordinary skilled of the art should recognize many alternatives, variations, and modifications. The weight-adjustable surface gliding apparatus is substantially the gliding apparatus 100 in FIG. 1, FIG. 2A, and FIG. 2B. As shown, similar to FIG. 4A, the gliding apparatus is placed on the floor surface as its handle structure is grabbed by one hand of a user and the disk top portion is flat held by another hand of the user. In an embodiment, a method for a user to perform total body exercise with a single surface-based gliding apparatus is provided. In particular, the user can place one of the gliding apparatus (FIG. 1) on a floor (indoor, outdoor, deck, yard, park, etc.) and use his/her first hand grabbing the handle structure and second hand holding flat on disk top of the gliding apparatus (see FIG. 4B) with both feet staying on the floor. Alternatively, the user can use both hands together to hold the handle structure of the gliding apparatus. Then, the method includes lowering the body down while keeping the whole body above the floor by applying muscular forces mainly from four limbs. Additionally, the exercise is performed by driving the gliding apparatus to initiate a gliding motion against the floor while coordinating total body position and keeping both feet together stationary on the floor. For example, user can drive the gliding apparatus to initiate a push motion for stretching the whole body with both arms straight and both hands in holding the handle structure of the gliding apparatus while still keeping the main body above the floor. Following the push out motion to the arm's limit, the user can drive the gliding apparatus back by initiating a pull motion either by bending the arms while keeping the body straight or by keeping the arms straight while bending the body up but keeping legs straight, or bending the knee part down, and keeping both feet stationary on the floor. The user can repeat the push/pull motion back and forth and adjust the rhythm, period, and total numbers of gliding motion. In a specific embodiment, the user can easily add one or more disk structure attached to the bottom of the existing disk structure of the gliding apparatus to increase the weight of the gliding apparatus, thereby enhancing the exercise intensity. Of course, there are many variations, alternatives, and modifications.

Figure 4C:
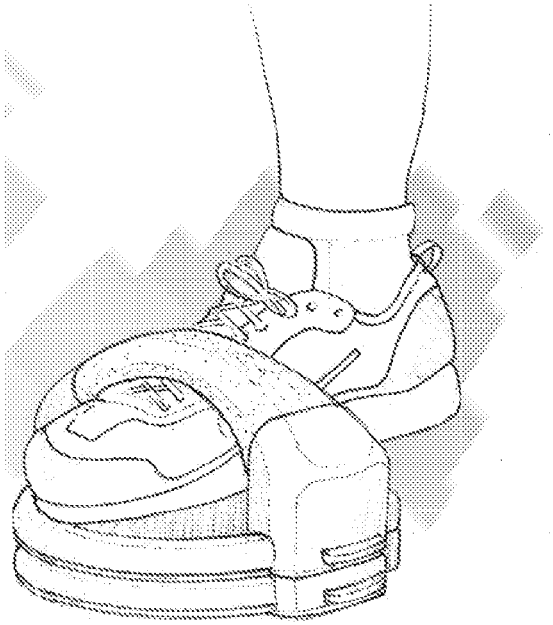
Figure 4D:
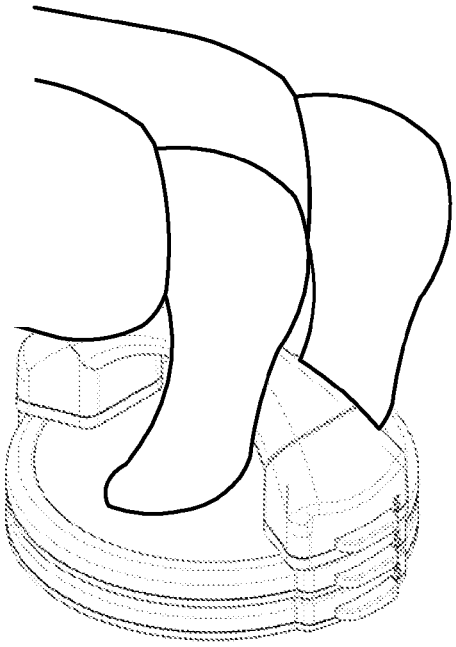

FIG. 4D is a schematic diagram showing the weight-adjustable surface gliding apparatus engaged by user's feet for exercise according to another alternative embodiment of the present invention. This diagram is merely an example, which should not unduly limit the scope of the claims herein. One in ordinary skilled of the art should recognize many alternatives, variations, and modifications. The weight-adjustable surface gliding apparatus is substantially the gliding apparatus 100 in FIG. 1, FIG. 2A, and FIG. 2B. As shown, two feet together are engaged with a single gliding apparatus by touching each toe portion on a top surface region of the disk structure at each side of the handle structure. In a specific embodiment, another method for a user to user the surface-based gliding apparatus for exercising is provided. In an embodiment of the method, the user can place three gliding apparatuses on a floor. Each gliding apparatus includes a handle structure including a handle-bar having two handle-ends respectively mounted on two end-base structures and a disk structure having a weight member clamped to a base member. The disk structure is removably coupled to the handle structure by locking the two end-base structures to two edge regions across the weight member. The two edge regions are configured for coupling from below to an alternative disk structure. By holding a handle structure of a first gliding apparatus by left hand and holding a handle structure of a second gliding apparatus by right hand, the user is supported by the two gliding apparatuses on the floor while lowering his/her body down. Additionally, the user can engage both feet on the disk structure of the third gliding apparatus with one foot on each side of the handle structure of the third gliding apparatus. Then the user can separately drive each gliding apparatus, held either by a hand or engaged by both feet, to initiate a gliding motion against the floor while keeping user's whole body above the floor in a balanced position. For example, when the first and second gliding apparatus held by hand are maintained in relative stationary state, the user can glide the third gliding apparatus by bending his/her knees or stretching his/her legs. In another example, the user can maintain relative stationary of the third gliding apparatus with both feet engaged thereon, he/she can independently drive the first and the second gliding apparatus by bending or stretching his/her arms with the main body part to coordinate the motion while keeping balance and above the floor.

In an alternative embodiment, the user can use two gliding apparatuses, one for two feet engaging the way mentioned above with another apparatus being held by both hands engaged in a way shown in FIG. 4B. Optionally, the user can use only one gliding apparatus with both feet engaged in a manner mentioned above while both his hands directly on the ground. The user can bend the knees one time followed by a gliding motion to stretch lower body while keeping the whole body balanced to do exercise. Again, the weight adjustable gliding apparatus provides advantage for the user to control the weight which in turn enhancing the exercise strength. Of course, there are many variations, alternatives, and modifications.

FIG. 4C is a schematic diagram showing the weight-adjustable surface gliding apparatus engaged by a user's foot for exercise according to another alternative embodiment of the present invention. This diagram is merely an example, which should not unduly limit the scope of the claims herein. One in ordinary skilled of the art should recognize many alternatives, variations, and modifications. The weight-adjustable surface gliding apparatus is substantially the gliding apparatus 100 in FIG. 1, FIG. 2A, and FIG. 2B. As shown, one of the user's foot (in a shoe) has its front section being inserted into an open space (140 in FIG. 2B) between the arc-shaped handle structure (112 in FIG. 2B) and the top surface (120 in FIG. 2B) of the disk structure coupled under the handle structure. In an embodiment, the present invention also provides a method of using the weight-adjustable gliding apparatus for a total body exercise. The method can be simplified by following steps. Firstly, a user places up to four gliding apparatuses on a floor surface. Each of the gliding apparatuses is substantially the same as described in this specification and illustrated in FIGS. 1, 2A and 2B. Secondly, the user can hold (as seen in FIG. 4A) a handle structure of a first gliding apparatus by one hand and hold a handle structure of a second gliding apparatus by another hand. Additionally, the user can manage to engage one of his/her foot into the open space between the handle-bar and a top surface of the disk structure of a third gliding apparatus (as seen in FIG. 4C) and engage another foot into the open space between the handle-bar and a top surface of the disk structure of a fourth gliding apparatus. The user has substantially lowered his/her body to level near but still above the floor surface. Then, the user can adjust his/her body position and change gestures of one or more of his/her four limbs to drive a corresponding one or more gliding apparatuses in a gliding motion against the floor surface. For example, he/she can move one or both arms to drive the first and/or the second gliding apparatus to glide independently or coordinately. One arm may stretch while the other may retreat or stretch too. In another example, he/she can move one or both legs by bending knees or stretching leg straight to initiate gliding motions of the third and the fourth gliding apparatuses. One knee may be in bent gesture while the other leg is stretched or bent too. In yet another example, four limbs can be moved coordinately while maintaining the whole body in balance above the floor surface. As four limbs move, rest part of the body also changes position, angle, or height above the floor. The user can repeat certain motions in certain distance and direction with certain rhythm. Furthermore, the user can adjust by attaching or detaching a disk structure to or from the existing gliding apparatus to increase or decrease the total weight of each gliding apparatus to adjust the exercise strength.

Of course, there are many variations, alternatives, and modifications. A user can always use one or more engagement manners or different combinations of the engagement manners to use the one or more gliding apparatuses for doing his/her exercise. For example, the user can use two hands flat on two separate apparatus with feet on floor to pull, push, stretch, or bend the body while rotating the body or keeping the body balanced above the floor. In another example, the user can use two hands holding handles of two separate apparatuses with feet on floor to pull, push, stretch, or bend the body while rotating the body or keeping the body balanced above the floor. In another example, the user can use one hand flat on an apparatus and one hand holding a handle of a separate apparatus with feet on the floor. In yet another example, the user can use two hands under the handle of one single apparatus with feet on floor to pull, push, stretch, or bend the body while rotating the body or keeping the body balanced above the floor. Alternatively, the user can use two hands holding handles of one apparatus with feet on floor to pull, push, stretch, or bend the body while rotating the body or keeping the body balanced above the floor. In another alternative example, the user can use two hands flat on two separate apparatus with two feet on either side of one handle on single apparatus on floor to pull, push, stretch, or bend the body while rotating the body or keeping the body balanced above the floor. Further, the user can use two hands holding handles of two separate apparatus with two feet on either side of one handle on single apparatus to pull, push, stretch, or bend the body while rotating the body or keeping the body balanced above the floor. Furthermore, the user can use one hand flat on an apparatus and one hand holding a handle of a separate apparatus with two feet on either side of one handle on single apparatus. Optionally, the user can use two hands under the handle of one single apparatus with two feet on either side of one handle on single apparatus to pull, push, stretch, or bend the body while rotating the body or keeping the body balanced above the floor. As another option, the user can use two hands holding handles of one apparatus with two feet on either side of one handle on single apparatus to pull, push, stretch, or bend the body while rotating the body or keeping the body balanced above the floor. Moreover, the user can use two hands flat on two separate apparatus with two feet under the handles of two separate apparatus to pull, push, stretch, or bend the body while rotating the body or keeping the body balanced above the floor.

It is also understood that the examples, figures, and embodiments described herein are for illustrative purposes only and that various modifications or changes in light thereof will be suggested to persons skilled in the art and are to be included within the spirit and purview of this application and scope of the appended claims.

What is claimed is:

1. An exercise apparatus for surface-based gliding, the apparatus comprising:

a handle structure including a handle-bar having two handle-ends respectively mounted on two end-base structures; and a disk structure having a weight member clamped to a base member, the disk structure being removably coupled to the handle structure by locking the two end-base structures to two edge regions across the weight member, the two edge regions being configured for coupling from below to an alternative disk structure;

wherein the handle structure is configured to allow a user to engage anywhere from the handle-bar to a top surface of the disk structure to drive said disk structure with the base member gliding against a surface in an arbitrary direction for exercise.

2. The apparatus of claim 1 wherein the handle-bar comprises a handle sleeve wrapped around thereof for the user to hold by a hand or both hands.

3. The apparatus of claim 1 wherein the handle structure further comprises a first spring latch device embedded within the end-base structure, the first spring latch device being configured to receive and lock a pin inserted through an open slot at a bottom of the end-base structure controlled by a pushbutton sticking out aside of the end-base structure.

4. The apparatus of claim 3 wherein the pin is an end segment of a bracket clamped between the weight member and the base member, the end segment sticking out upward from one of the two edge regions of the disk structure.

5. The apparatus of claim 4 wherein the disk structure further comprises a second spring latch device disposed under each of the two edge regions, the second spring latch device being configured to receive and lock a pin inserted through an open slot at the base member of the disk structure controlled by a pushbutton sticking out aside of the edge region, the second spring latch device being substantially the same as the first spring latch device.

6. The apparatus of claim 1 wherein the disk structure further comprises a pad member attached overlying a whole top part of the weight member, the pad member facilitating an engagement by a human body including at least a hand or a foot.

7. The apparatus of claim 1 wherein the weight member is configured to provide a total weight of every said disk structure ranging from 1 pound to 10 pounds selected for facilitating exercise result.

8. The apparatus of claim 7 wherein the total weight of every said disk structure is 5 pounds or less.

9. The apparatus of claim 1 wherein the base member comprises a light-weight hard plastic material made from Acrylonitrile butadiene styrene (ABS) facilitating the gliding motion against a surface made or covered by a material selected from a wood, a fiber, ceramic, plastic, metal, concrete, stone, or synthesize composite.

10. The apparatus of claim 1 further comprising one or more alternative disk structures being consecutively coupled to the disk structure from below, each of the one or more alternative disk structures being substantially duplicated from said disk structure for providing incremental weight with enhanced exercise strength.

11. An exercise apparatus for gliding against a surface, the apparatus comprising:

a handle structure including a handle-bar having two handle-ends respectively mounted on two end-base structures, each end-base structure being associated with a first latch locking device; and a disk structure including a pair of edge structures, each edge structure being associated with a pin segment and a second latch locking device, the pin segment being configured to engage upward with the first latch locking device to couple the disk structure to the handle structure, the second latch locking device being configured for engaging downward with a pin segment associated with an alternative disk structure, the alternative disk structure being a substantial duplication of the disk structure;

wherein the handle structure is configured to allow a user to engage and drive the coupled disk structure with its bottom side gliding in an arbitrary direction against a surface for exercise.

12. The apparatus of claim 11 wherein the first latch locking device comprises a spring latch having a receiving passage through a solid piece of material with an end button partially sticking out of the end-base structure from aside, the spring latch being configured in a compress mode by pushing the end button from outside of the end-base structure to allow the receiving passage to align to an open slot at a bottom of the end-base structure.

13. The apparatus of claim 12 wherein the pin segment comprises a hole near its end region, the pin segment being configured to partially stick out of the edge structure upward for plugging into the open slot at the bottom of the end-base structure and through the aligned receiving passage of the spring latch in the compress mode, then allowing the hole to be locked by the spring latch end button in a release mode as the end button is released.

14. The apparatus of claim 12 wherein the second latch locking device comprises a spring latch having a receiving passage through a solid piece of material with an end button partially sticking out of the edge structure from aside, the spring latch of the second locking device being configured in a compress mode by pushing the end button from outside of the edge structure to allow the receiving passage of the second locking device to align to an open slot at a bottom of the edge structure, the spring latch being substantially the same as the spring latch associated with the first latch locking device.

15. The apparatus of claim 11 wherein the handle structure comprises a sleeve wrapped around the handle-bar configured for either a single hand or both hands of the user to hold.

16. The apparatus of claim 11 wherein the disk structure comprises a weight member clamped between a top member and a base member, the weight member being configured to provide a standardized total weight of every disk structure.

17. The apparatus of claim 16 wherein the total weight of every disk structure is selected from 1 pound to 10 pounds for facilitating personalized exercise.

18. The apparatus of claim 16 wherein the total weight of every disk structure is 5 pounds or less.

19. The apparatus of claim 16 wherein the disk structure comprises a pad member attached to a top surface of the top member, the pad member being configured to allow direct engagement at least by one or both hands or by one or both feet of the user.

20. The apparatus of claim 16 wherein the base member comprises a light-weight hard plastic material made from Acrylonitrile butadiene styrene (ABS) facilitating the gliding motion against a surface made or covered by a material selected from a wood, a fiber, ceramic, plastic, metal, concrete, stone, or synthesize composite.

21. The apparatus of claim 11 further comprising one or more alternative disk structures being engaged and removably locked from below with the disk structure, each of the one or more alternative disk structures being substantial a duplicate of said disk structure for providing controlled incremental weight for exercises with enhanced strength.

22. A method for a user to use one or more weight-adjustable gliding apparatuses for total body exercise, the method comprising:

placing one or more gliding apparatuses on a floor, each gliding apparatus comprising:

a handle structure including a handle-bar having two handle-ends respectively mounted on two end-base structures; and a disk structure having a weight member clamped to a base member, the disk structure being removably coupled to the handle structure by locking the two end-base structures to two edge regions across the weight member, the two edge regions being configured for coupling from below to an alternative disk structure;

using one hand to grab the handle structure of one of the one or more gliding apparatuses and another hand to grab the handle structure or hold a top flat portion of the disk structure of another one of the one or more gliding apparatuses;

lowering the user's body down by applying muscular forces from four limbs with each hand holding one gliding apparatus against the floor and both feet remaining on the floor;

driving the gliding apparatus to initiate a gliding motion against the floor by bending and stretching the arms up to the user's arm length, the gliding motion being in an arbitrary direction controlled by adjusting muscular forces via one or two hands holding the handle structure of the gliding apparatus while keeping a balance of the whole body above the floor except the feet.

23. The method of claim 22 wherein the gliding apparatus further comprises an alternative disk structure coupled from below to the disk structure to add total weight to the gliding apparatus, the alternative disk structure being substantially the same as the disk structure.

24. A method for a user to use a weight-adjustable gliding apparatus for total body exercise, the method comprising:

placing a gliding apparatus on a floor, the gliding apparatus comprising:

a handle structure including a handle-bar having two handle-ends respectively mounted on two end-base structures; and a disk structure having a weight member clamped to a base member, the disk structure being removably coupled to the handle structure by locking the two end-base structures to two edge regions across the weight member, the two edge regions being configured for coupling from below to an alternative disk structure;

using both hands to engage the gliding apparatus, one hand grabbing the handle structure while the other hand either grabbing the same handle structure or holding flat on the disk structure below the handle structure;

lowering the user's body down while keeping the whole body above the floor except both feet by applying muscular forces from four limbs with both hands holding the handle structure of the gliding apparatus against the floor;

driving the gliding apparatus to initiate a gliding motion against the floor by coordinating total body position while keeping both feet together stationary on the floor.

25. The method of claim 24 further comprising coupling an alternative disk structure from below to the disk structure to add total weight to the gliding apparatus, the alternative disk structure being substantially the same as the disk structure.

26. The method of claim 24 wherein driving the gliding apparatus comprises initiating a push motion for stretching the user's whole body with both arms straight and both hands in holding the handle structure of the gliding apparatus while still keeping the main body above the floor.

27. The method of claim 24 wherein driving the gliding apparatus further comprises initiating a pull motion either by bending the arms while keeping the body straight or by keeping the arms straight while bending the body up but keeping the legs straight or bending the knees down and keeping both feet stationary on the floor.

28. A method for a user to use a floor-based weight-adjustable gliding apparatus for total body exercise, the method comprising:

placing a plurality of gliding apparatuses on a floor, each gliding apparatus comprising:

a handle structure including a handle-bar having two handle-ends respectively mounted on two end-base structures; and a disk structure having a weight member clamped to a base member, the disk structure being removably coupled to the handle structure by locking the two end-base structures to two edge regions across the weight member, the two edge regions being configured for coupling from below to an alternative disk structure;

holding a handle structure of a first gliding apparatus by one hand of the user and holding a handle structure of a second gliding apparatus by another hand of the user, each of the first gliding apparatus and the second gliding apparatus being one of the plurality of gliding apparatuses;

engaging both feet of the user on the disk structure of a third gliding apparatus with one foot on each side of the handle structure of the third gliding apparatus, the third gliding apparatus being one of the plurality of gliding apparatus;

driving each gliding apparatus held by a hand or engaged by both feet separately to initiate a gliding motion against the floor while keeping user's whole body above the floor.

29. The method of claim 28 wherein each gliding apparatus further comprises an alternative disk structure removably coupled from below to the disk structure to add total weight to the gliding apparatus, the alternative disk structure being substantially the same as the disk structure.

30. The method of claim 28 wherein driving each gliding apparatus comprises initiating a gliding motion of the first/second gliding apparatus held by a first/second hand by bending and stretching the user's corresponding arm up to its length while keeping the third gliding apparatus engaged by both feet in a stationary state with both legs in a straight gesture.

31. The method of claim 28 wherein driving each gliding apparatus comprises initiating a gliding motion of the third gliding apparatus against the floor by bending the knees or stretching the legs up to its length while keeping the first/second gliding apparatus held by the first/second hand of the user in a stationary state.

32. The method of claim 28 wherein driving each gliding apparatus comprises initiating a first gliding motion of the first/second gliding apparatus held by a first/second hand by bending and stretching the user's corresponding arm while keeping the third gliding apparatus stationary with a straight leg gesture and subsequently initiating a second gliding motion of the third gliding apparatus engaged by both feet by bending and stretching the user's legs while keeping the first/second gliding apparatus in a stationary state.

33. The method of claim 28 wherein driving each gliding apparatus comprises initiating gliding motions of the first, second, and third gliding apparatus at the same time through alternative pull-in and push-out arm/leg bending/stretching while keeping balance of the user's whole body above the floor.

34. A method for a user to use a surface-based weight-adjustable gliding apparatus for total body exercise, the method comprising:

placing a plurality of gliding apparatuses on a surface, each gliding apparatus comprising:

a handle structure including a handle-bar having two handle-ends respectively mounted on two end-base structures; and a disk structure having a weight member clamped to a base member, the disk structure being removably coupled to the handle structure by locking the two end-base structures to two edge regions across the weight member and leaving an open space between the handle-bar and a top surface of the weight member, the two edge regions being configured for coupling from below to an alternative disk structure;

holding a handle structure of a first gliding apparatus by one hand of the user and holding a handle structure of a second gliding apparatus by another hand of the user, each of the first gliding apparatus and the second gliding apparatus being one of the plurality of gliding apparatuses;

engaging a foot of the user into the open space between the handle-bar and a top surface of the weight member of a third gliding apparatus and engaging another foot of the user into the open space between the handle-bar and a top surface of the weight member of a fourth gliding apparatus, each of the third gliding apparatus and the fourth gliding apparatus being one of the plurality of gliding apparatus;

driving each gliding apparatus held by a hand or engaged by a foot to independently initiate an arbitrary gliding motion against the surface while coordinating muscular force via each of the four limbs to keep balance of the user's whole body in various bending/stretching gestures above the surface.

35. The method of claim 34 wherein each gliding apparatus further comprises an alternative disk structure removably coupled from below to the disk structure to add total weight to the gliding apparatus, the alternative disk structure being substantially the same as the disk structure.

* * * * *